US005226821A

United States Patent [19]

Murphy et al.

[11] Patent Number: 5,226,821

[45] Date of Patent: Jul. 13, 1993

[54] HOCKEY TRAINING DEVICE

[75] Inventors: John B. Murphy, Lake Forest; Richard M. Shea, Antioch, both of Ill.

[73] Assignee: Stickmaster, Inc., Lake Villa, Ill.

[21] Appl. No.: 835,710

[22] Filed: Feb. 12, 1992

[51] Int. Cl.[5] ..... A63B 69/00; G09B 9/00; G09B 19/00

[52] U.S. Cl. ..... 434/247

[58] Field of Search ..... 434/247, 261; 33/474, 33/419, 420; 273/67 A

[56] References Cited

U.S. PATENT DOCUMENTS 81,720 9/1868 Williams ..... 33/419
614,259 11/1898 Bouldry ..... 33/419
1,845,449 5/1929 Smith ..... 33/474
2,582,892 1/1952 Tarperi ..... 33/419
3,153,859 10/1964 Jones ..... 33/419

*Primary Examiner*—Gene Mancene
*Assistant Examiner*—Cindy A. Cherichetti
*Attorney, Agent, or Firm*—Willian Brinks Olds Hofer Gilson & Lione

[57] ABSTRACT

A hockey training device includes a base having a first end and a second end, a side having a bottom end and a top end, a telescoping connector, and at least one locating surface mounted on the hockey training device to support the hockey training device above a playing surface. The bottom end of the side is pivotally connected to the first end of the base and the telescoping connector is pivotally connected to the second end of the base and the top end of the side, such that the base, side and telescoping connector form a triangle.

18 Claims, 3 Drawing Sheets 10
14
18
22
26
30
34
38
40
42
46
50
54
58
62
66
70
74
78
3
4
5

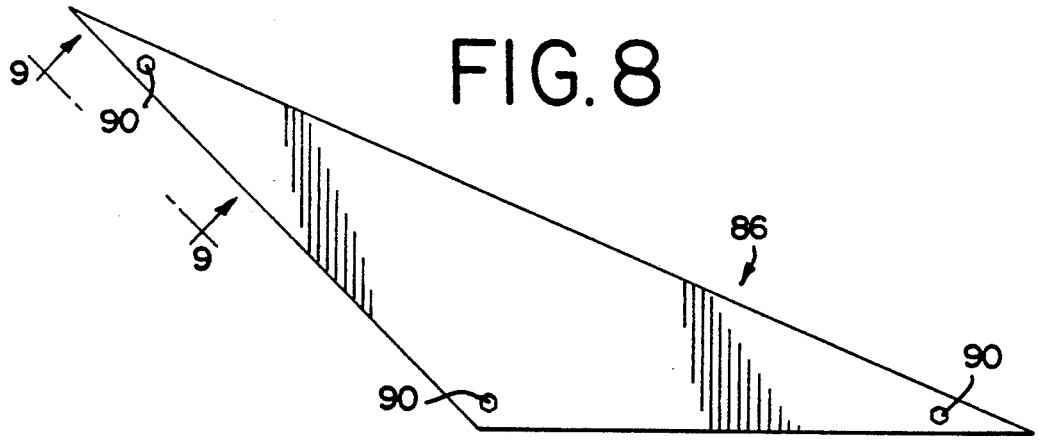
FIG. 8
FIG. 9
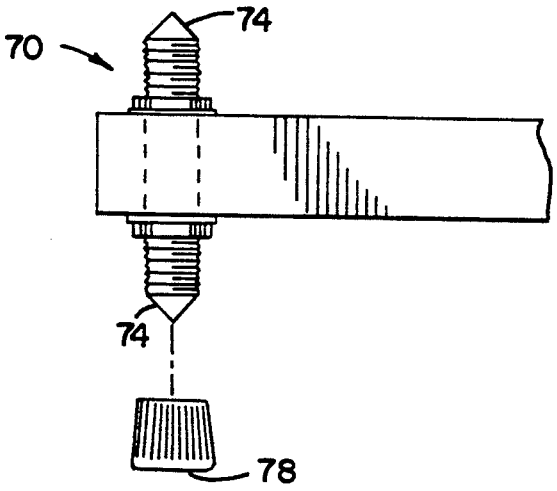
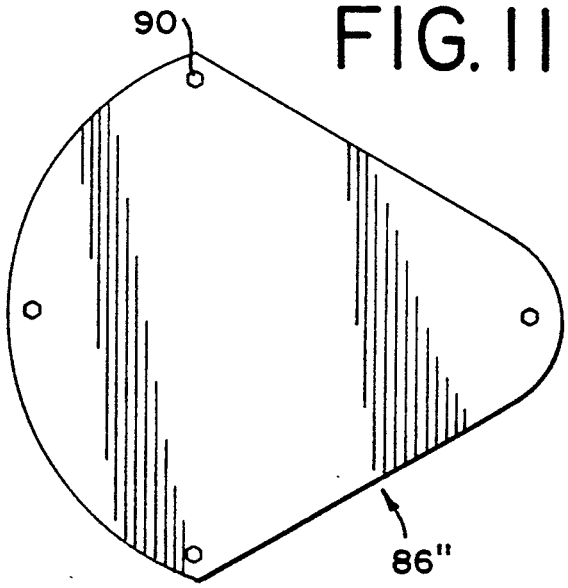
FIG. 11
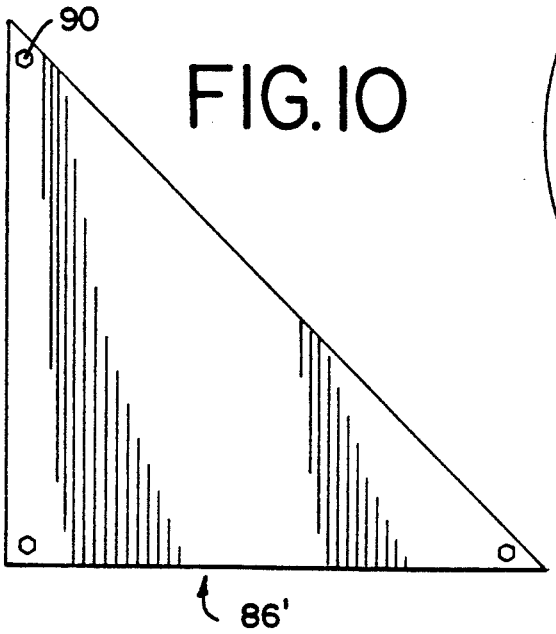
FIG. 10

HOCKEY TRAINING DEVICE

BACKGROUND OF THE INVENTION

This invention relates generally to the field of hockey training devices, and particularly to hockey puck-handling training devices.

Puck-handling is an important aspect of the game of hockey. Proficient puck-handling allows a hockey player to outmaneuver opponents and to prevent them from taking possession of the puck. Furthermore, proficient puck-handling helps hockey players to make better passes to teammates and to deliver better shots.

Because puck-handling is such an important part of the game of hockey, training exercises focusing on this aspect of the game have been performed since the game originated. A typical puck-handling training exercise consists of a player moving a puck quickly in a triangle in front of him. In this exercise, the player positions the puck as far as possible away from his body, moves the puck quickly into his body, then across his body, and back out again. In this way, the player learns to utilize his reach in maneuvering the puck, and also develops the hand-to-eye coordination required to maneuver the puck adeptly.

In teaching this training exercise, coaches usually instruct their players to imagine a triangle on the playing surface, and to move the puck along that imaginary triangle in the manner discussed above.

Instead of utilizing an imaginary triangle, some coaches place pucks or cones on the playing surface to define a triangular shape.

A major disadvantage of the above-described training exercises is that the motion of the puck is not constrained along a permanent course. That is, especially in the exercise using an imaginary triangle, the player most likely does not follow the same course during the numerous repetitions of the training exercise. Also, the extension of the player's reach may decrease after multiple repetitions of the exercise. These phenomena decrease the effectiveness of the training exercise because the player is not compelled to utilize his entire reach during the exercise and he does not practice the precise movements required to control the movement of the puck effectively. Furthermore, the presence of cones on the playing surface may interfere with the movement of a player's hockey stick when he is performing the training exercise.

It is, therefore, an object of the present invention to provide a hockey puck-handling training device that defines a constant training path along which a hockey puck may be moved.

It is another object of the present invention to provide a hockey puck-handling training device that may be altered to define many different training paths.

It is still another object of the present invention to provide a hockey puck-handling training device that encourages the hockey player to utilize more of his available reach when he is performing the training exercise.

SUMMARY OF THE INVENTION

According to a first aspect of the present invention, a hockey training device is provided including a base having a first end and a second end, a side having a bottom end and a top end, a telescoping connector, and at least one locating surface mounted on the hockey training device to support the hockey training device above a playing surface. The bottom end of the side is pivotally connected to the first end of the base and the telescoping connector is pivotally connected to the second end of the base and the top end of the side, such that the base, side and telescoping connector form a triangle.

According to a second aspect of the present invention, a hockey training device is provided including a template shaped to define a desired training motion, and a plurality of studs mounted on the template for holding the hockey training device in place on a playing surface. Each of the plurality of studs includes a three-position stud having a neutral position wherein the stud lies in the same plane as the hockey training device, a top position wherein the stud extends above a first face of the hockey training device, and a bottom position wherein the stud extends above a second face of the hockey training device.

According to a third aspect of the present invention, a hockey training device is provided including a template shaped to define a desired training motion, and a plurality of height adjustable support surfaces mounted on the template to support the hockey training device above a playing surface. The plurality of height adjustable support surfaces define a first position where a hockey puck is prevented from moving beneath the hockey training device and a second position where the hockey puck is permitted to move beneath the hockey training device.

According to a fourth aspect of the present invention, a method of practicing hockey puck-handling training skills is provided including the following steps: providing a puck-handling training device including a template shaped to define a desired training motion, and at least one locating surface mounted on the puck-handling training device to hold the puck-handling training device in position on a playing surface; placing the puck-handling training device on a playing surface; placing a hockey puck on the playing surface adjacent to the puck-handling training device; and directing the hockey puck with a hockey stick along at least a perimeter portion of the puck-handling training device.

The invention itself, together with further objects and attendant advantages, will best be understood by reference to the following detailed description taken in conjunction with the accompanying drawings.

BRIEF DESCRIPTION OF THE DRAWINGS

FIG. 8 is a top view of a hockey training device which incorporates an alternate embodiment of the present invention;

FIG. 9 is an enlarged view taken along line 9—9 of FIG. 8;

FIGS. 10 and 11 are top views of hockey training devices which incorporate alternate embodiments of the present invention;

DETAILED DESCRIPTION OF THE PRESENTLY PREFERRED EMBODIMENTS

Figures 1, 2, 3, 4, 5, 6, 7:
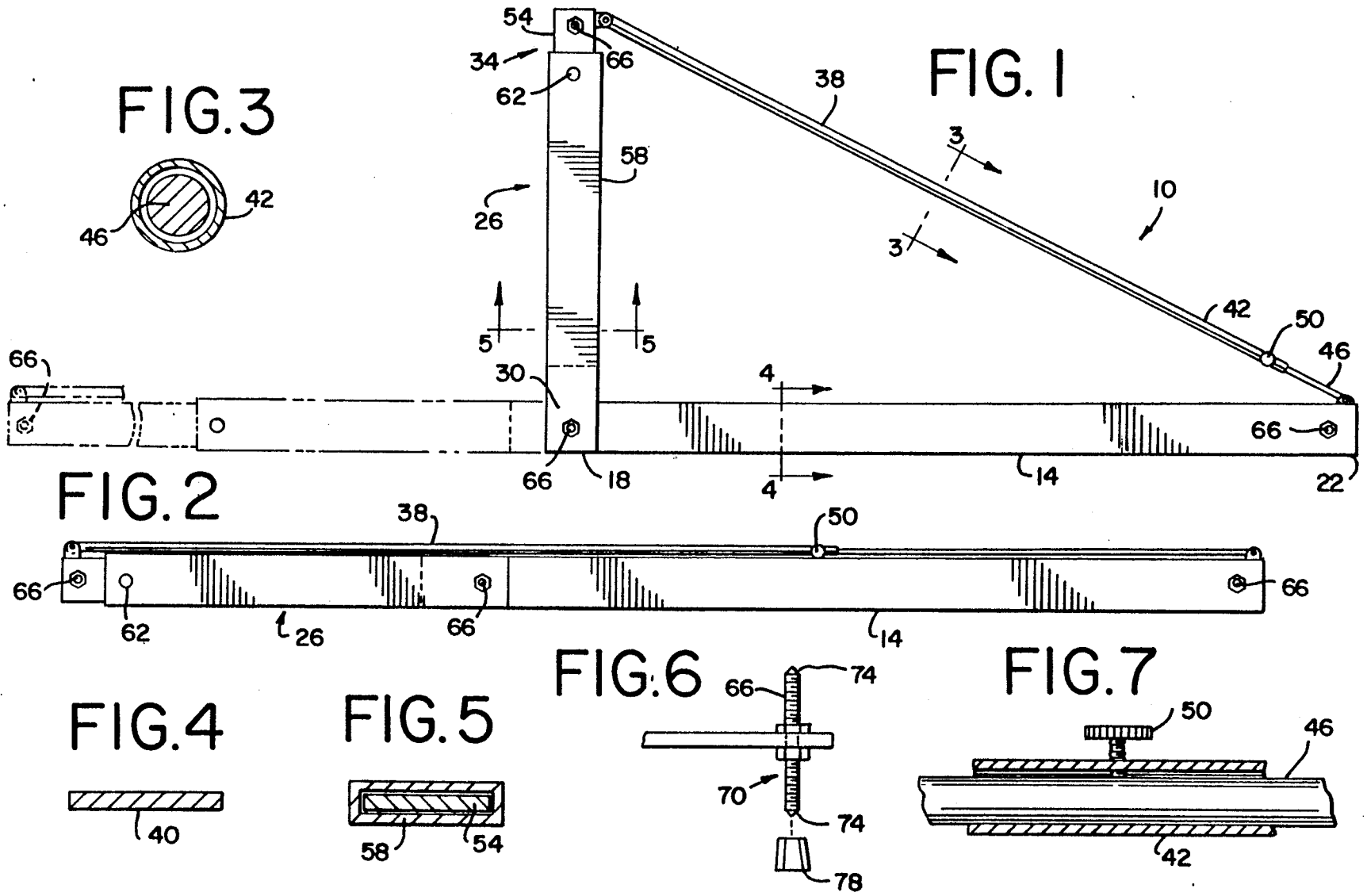
FIG. 1 is a top view of a hockey training device which incorporates a presently preferred embodiment of the present invention.
FIG. 2 is a top view of the hockey training device of FIG. 1 when the side member is pivoted to a position where it is positioned in line with the base.
FIG. 3 is a cross-sectional view taken along line 3—3 of FIG. 1.
FIG. 4 is a cross-sectional view taken along line 4—4 of FIG. 1.
FIG. 5 is a cross-sectional view taken along line 5—5 of FIG. 1.
FIG. 6 is an elevational view of a stud mounted on the hockey training device of FIG. 1.
FIG. 7 is an enlarged view, partially in cross-section, of an releasable lock included in the hockey training device of FIG. 1.

As shown in FIG. 1, the presently preferred embodiment 10 of the hockey training device includes a base 14 having a first end 18 and a second end 22, a side 26 having a bottom end 30 and a top end 34, a telescoping connector 38, and at least one locating surface 66 mounted on the hockey training device 10 to support the hockey training device 10 above a playing surface (not shown).

The bottom end 30 of the side 26 is pivotally connected to the first end 18 of the base 14 and the telescoping connector 38 is pivotally connected to the second end 22 of the base 14 and to the top end 34 of the side 26, such that the base 14, side 26 and telescoping connector 38 form a triangle.

The base 14 may be configured in any suitable form. As shown in FIG. 4, the base 14 is formed from a solid bar 40 in this embodiment.

As shown in FIG. 2, the side 26 of the hockey training device 10 is pivotable to a position in which the side 26 is positioned in line with the base 14. The telescoping connector 38 elongates in order for the hockey training device 10 to assume the configuration shown in FIG. 2. As best shown in FIG. 3, the telescoping connector 38 preferably includes a solid rod 46 slidably disposed within a tubular channel 42. The telescoping connector 38 further includes a releasable lock 50 to maintain the hockey training device 10 in a desired configuration. FIG. 7 shows a view of the releasable lock 50 engaging the solid rod 46 of the telescoping connector 38.

Due to the pivotable nature of the side 26 and the telescoping ability of the telescoping connector 38, the hockey training device 10 may be configured in a variety of triangular shapes. These different shapes will allow hockey players to practice different puck-handling motions.

In the embodiment of FIGS. 1-7, the side 26 of the hockey training device 10 is configured to telescope. This feature allows the hockey training device 10 to be adjusted in size, and it has the advantage of compelling practicing hockey players to fully extend their reach in moving a hockey puck. To provide this telescoping feature, the side 26 preferably includes, as best shown in FIG. 5, a solid part 54 slidably disposed within a box channel 58. The telescoping side 26 further includes an adjustable lock 62 operative to secure the solid part 54 in a desired position within the box channel 58.

The locating surfaces 66 are configured to engage the playing surface (not shown) no matter which face of the hockey training device 10 is positioned near the playing surface. This feature allows the hockey training device 10 to be inverted such that both left-and right-handed players may be accommodated.

The locating surfaces 66 are configured to support the hockey training device 10 above any playing surface suitable for the application. Such playing surfaces include a gym floor, cement, asphalt and ice.

In the preferred embodiment of FIGS. 1-7, the locating surfaces comprise a plurality of studs 66 mounted on the base 14 and the side 26 of the hockey training device 10. As shown in FIG. 6, the studs 66 each include a threaded rod 70 having two pointed ends 74. While only one pointed end 74 engages the playing surface at any given time, the other pointed end 74 is constantly positioned to engage the playing surface if and when the hockey training device 10 is inverted.

The studs 66 may further include a cover 78 that fits over the pointed end 74 of the threaded rod 70 that is not being used to secure the hockey training device 10 to the playing surface.

The threaded rod 70 of each stud 66 may be adjusted to raise and lower the height of the hockey training device 10 with respect to the playing surface. The maximum height above the playing surface that the hockey training device may attain is no more than about 2 inches. This feature permits the hockey training device 10 to be raised to a height where a hockey puck is allowed to slide beneath the hockey training device 10, or to be lowered to a height such that a hockey puck is prevented from sliding beneath the hockey training device 10. Retaining nuts 82 may also be threaded on the threaded rod 70 of the studs 66 to lock the hockey training device 10 in a desired height position.

Figure 13:
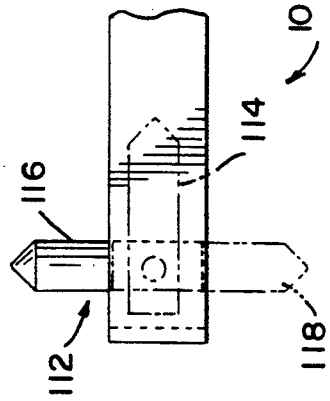
FIG. 13 is an enlarged view taken along line 9—9 of FIG. 8 showing an alternate embodiment of the locating surface.
Figure 14:
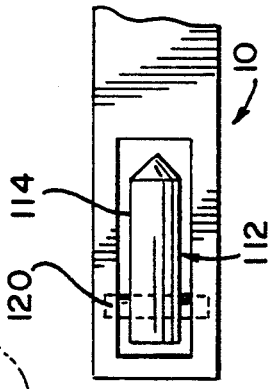
FIG. 14 is a top view of FIG. 13.

In an alternate embodiment, as shown in FIGS. 13 and 14, the studs 66 each comprise a three-position stud 112 having a neutral position 114 wherein the stud 112 lies in the plane defined by the hockey training device 10, a top position 116 wherein the stud 112 extends above a face of the hockey training device 10, and a bottom position 118 wherein the stud 112 extends above a second face of the hockey training device 10. The stud 112 is connected to a shaft 120 that includes detents for receiving a spring-loaded ball bearing (not shown). The detents and the spring-loaded ball bearing cooperate to support the stud 112 in the above-described positions 114, 116, 118.

As shown in FIGS. 8, 10 and 11, alternate embodiments of the hockey training device 10 include various templates 86, 86', 86" shaped to define desired puck-handling training motions. The templates 86, 86', 86" may be solid, one-piece structures, or they may have open central regions. The templates 86, 86', 86" may include height adjustable support surfaces 90 to raise and lower the templates with respect to the playing surface. Preferably, the height adjustable support surfaces comprise either the studs 66 or the three-position studs (112) discussed above.

Figure 12:
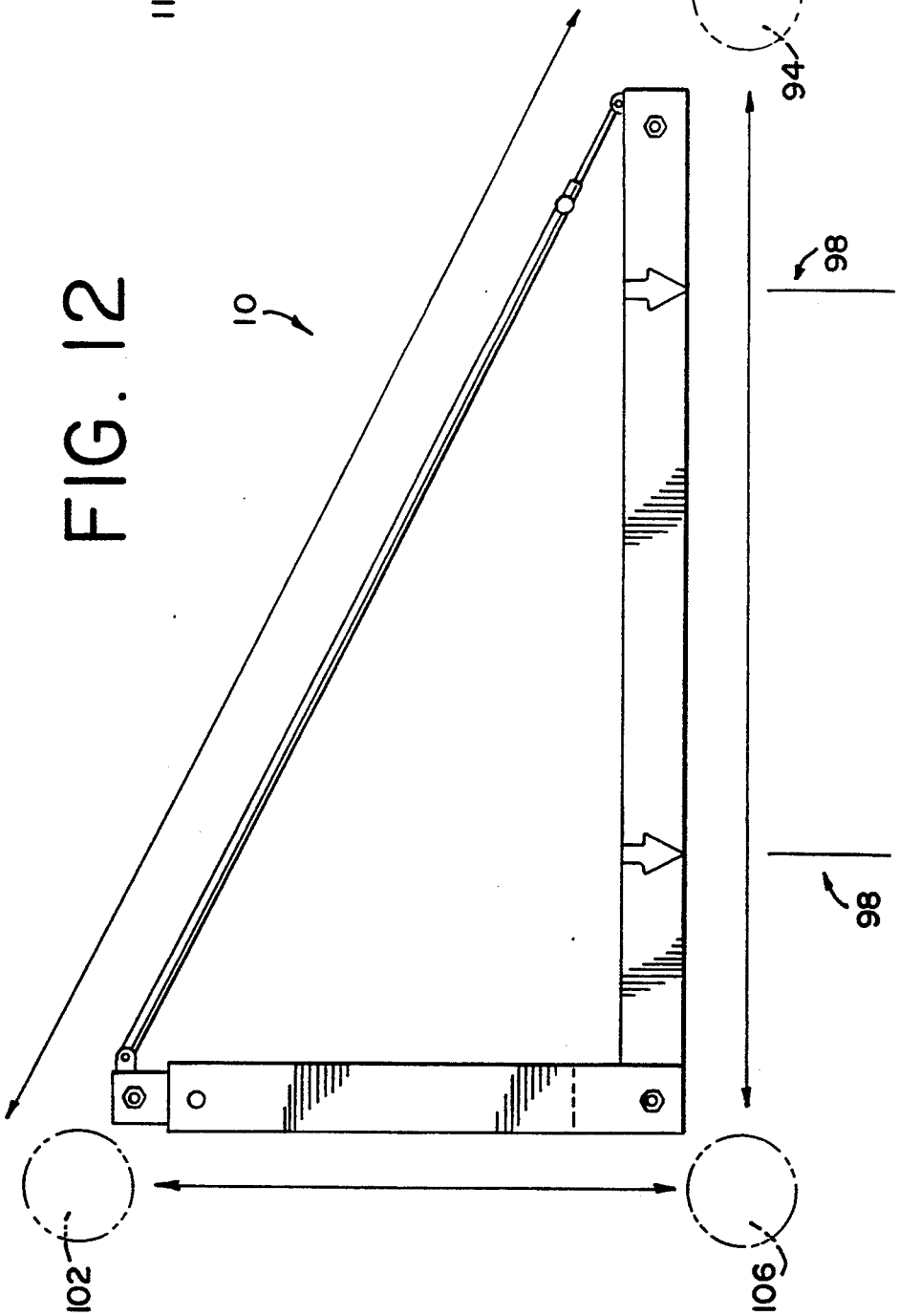
FIG. 12 is a top view of the hockey training device of FIG. 1 which shows a path taken by a hockey puck along the perimeter of the hockey training device.

As illustrated in FIG. 12, the hockey puck-handling training device 10 is used by placing the puck-handling training device 10 on a playing surface, placing a hockey puck 94 on the playing surface adjacent to the puck-handling training device 10, and directing the hockey puck 94 with a hockey stick (not shown) along at least a perimeter portion of the puck-handling training device 10.

If studs 66 are used to support the hockey training device 10 above the playing surface, the hockey player may adjust the studs 66 to raise or lower the hockey training device 10. In this manner, the hockey player can set the height of the hockey training device 10 to either allow or prevent the hockey puck 94 from sliding beneath the hockey training device 10.

For a left-handed player, the typical orientation of the hockey training device 10 is shown in FIG. 12. The two lines 98 represent the typical position of a hockey player's feet when using the hockey training device 10. However, a hockey player may position his feet on any side of the hockey training device 10 when using the hockey training device 10. After positioning himself adjacent to the hockey training device, as represented by the two lines 98, the hockey player typically places the hockey puck 94 in a first position 102 adjacent to the hockey training device 10. With his hockey stick, the hockey player then moves the hockey puck 94 quickly into his body to a second position 106. Next, the hockey player moves the hockey puck 94 across his body to a third position 110. Finally, the hockey player moves the hockey puck 94 from the third position 110 along a path to the first position 102. This exercise is repeated until the hockey player becomes comfortable with that specific motion.

The hockey player need not perform the exact drill as described above. Rather, the hockey player could maneuver the hockey puck 94 in the opposite direction around the perimeter of the hockey training device 10. Alternately, the hockey player can move the hockey puck 94 along only one or two sides of the hockey training device 10.

If the hockey training device 10 as shown in FIG. 1 is used, the hockey player may extend one or both of the side 26 and the telescoping connector 38 to alter the configuration of the hockey training device 10, thereby creating a different puck-handling motion. If the left-handed player of FIG. 12 wants to practice using his right hand, or if a right-handed player wants to use the hockey training device 10 when the left-handed player is finished, the player only has to invert the hockey training device 10.

The method described above can be practiced with a variety of templates 86, 86', 86'' as shown in FIGS. 8, 10 and 11. Players can take turns practicing the different puck-handling motions defined by the various templates 86, 86', 86''.

The base 14, side 26 and the telescoping connector 38 of the hockey training device 10 may be formed of any material suitable for the application, including stainless steel, plastic, and aluminum. The studs 66 are preferably formed of stainless steel. The templates 86, 86', 86'' may also be formed of any suitable material, including plywood.

The hockey training device as shown in FIGS. 1 and 2 has the following approximate dimensions: the base is 24 inches, the side is 13.25 inches, and the telescoping connector is 27.4 inches. Thus, when the side is pivoted to a position in line with the base, as depicted in FIG. 2, the total length of the device reaches 37.25 inches. When the side of the hockey training device is configured to telescope, the side may extend to a maximum length of approximately 24 inches.

It should be understood that a wide range of changes and modifications may be made to the preferred embodiments described above. Therefore, it is intended that the foregoing detailed description be regarded as illustrative rather than limiting, and that it be understood that it is the following claims, including all equivalents, which are intended to define the scope of this invention.

We claim:

1. A hockey training device, comprising:

a) a solid base having a first end and a second end;

b) a telescoping side having a bottom end and a top end, said telescoping side comprising:

i) a box channel, ii) a solid bar slidably disposed within the box channel, and iii) an adjustable lock to secure the solid bar in a desired position within the box channel, the bottom end of said telescoping side corresponding with the box channel and pivotally connected to the first end of said solid base, and the top end of said telescoping side corresponding with the solid bar;

c) a telescoping connector pivotally connected to the second end of said solid base and the top end of said telescoping side such that said solid base, said telescoping side and said telescoping connector form a triangle, said telescoping connector comprising:

i) a tubular channel, ii) a solid rod slidably disposed within the tubular channel, and iii) a releasable lock to secure the solid rod in a desired position within the circular channel; and d) a plurality of studs mounted on said solid base and said telescoping side, and securing the hockey training device to a playing surface, each of said studs comprising:

i) a threaded rod having two pointed ends, each pointed end positioned to secure a respective face of the hockey training device to the playing surface, and ii) a cover that fits over the pointed end of the threaded rod that is not being used to engage the hockey training device with the playing surface.

2. A hockey training device, comprising:

a) a template shaped to define a desired training motion; and b) a plurality of studs mounted on said template, each of said studs comprising a three-position stud having a neutral position wherein the stud lies in the same plane as the hockey training device, a top position wherein the stud extends above a first face of the hockey training device, and a bottom position wherein the stud extends above a second face of the hockey training device, said plurality of studs securing the hockey training device to a playing surface.

3. The hockey training device as claimed in claim 2 wherein said template comprises:

a) a base having a first end and a second end;

b) a side having a bottom end and a top end, the bottom end of the side pivotally connected to the first end of the base; and c) a connector pivotally connected to the second end of the base and the top end of the side.

4. The hockey training device as claimed in claim 3 wherein the connector comprises first and second parts, and wherein the second part is configured to telescope with respect to the first part.

5. A method of practicing hockey puck-handling skills, which comprises:

a) providing a puck-handling training device comprising:

i) a base having a first end and a second end, ii) a side having a bottom end and a top end, the bottom end of the side pivotally connected to the first end of the base, iii) a telescoping connector pivotally connected to the second end of the base and the top end of the side such that the base, the side and the telescoping connector form a triangle, and iv) at least one locating surface mounted on said puck-handling training device to support said puck-handling training device above a playing surface;

b) placing said puck-handling training device on a playing surface;

c) placing a hockey puck on the playing surface adjacent to said puck-handling training device; and d) directing said hockey puck with a hockey stick along at least a perimeter portion of said puck-handling training device.

6. The method of practicing hockey puck-handling skills as claimed in claim 5, further comprising the step of repeating steps b) through d) with said puck-handling training device in an altered configuration to cause a hockey player to practice different puck-handling motions.

7. The method of practicing hockey puck-handling skills as claimed in claim 5, further comprising the step of inverting said puck-handling training device to accommodate both left- and right-handed hockey players.

8. The method of practicing hockey puck-handling skills as claimed in claim 5 wherein the playing surface is ice.

9. The method of practicing hockey puck-handling skills as claimed in claim 5 wherein said hockey puck is moved with the hockey stick along at least one side of said puck-handling training device.

10. The method of practicing hockey puck-handling skills as claimed in claim 5 wherein the at least one locating surface comprises a plurality of studs mounted on the base and the side of said puck-handling training device.

11. The method of practicing hockey puck-handling skills as claimed in claim 10, further comprising the step of adjusting the plurality of studs to raise said puck-handling training device with respect to the playing surface, whereby said hockey puck is allowed to slide beneath said puck-handling training device.

12. A method of practicing hockey puck-handling skills, which comprises:

a) providing a puck-handling training device comprising:

i) a template shaped to define a desired training motion, and ii) at least one locating surface mounted on said puck-handling training device to support said puck-handling training device above a playing surface;

b) placing said puck-handling training device on a playing surface;

c) placing a hockey puck on the playing surface adjacent to said puck-handling training device; and d) directing said hockey puck with a hockey stick along at least a perimeter portion of said puck-handling training device.

13. The method of practicing hockey puck-handling skills as claimed in claim 12 wherein the at least one locating surface comprises a plurality of studs mounted on the template of said puck-handling training device.

14. The method of practicing hockey puck-handling skills as claimed in claim 13, further comprising the step of adjusting the plurality of studs to raise said puck-handling training device with respect to the playing surface, whereby said hockey puck is allowed to slide beneath said puck-handling training device.

15. A hockey training device, comprising:

a) a base having a first end and a second end;

b) a side having a bottom end and a top end, the bottom end of said side pivotally connected to the first end of said base;

c) a telescoping connector pivotally connected to the second end of said base and the top end of said side such that said base, said side and said telescoping connector form a triangle; and d) a plurality of studs mounted on the hockey training device to support the hockey training device above a playing surface, each of said plurality of studs comprising a threaded rod having two pointed ends, each pointed end positioned to engage the playing surface.

16. The hockey training device as claimed in claim 15 wherein each of said studs further comprises a cover that fits over the pointed end of the threaded rod that is not being used to engage the hockey training device with the playing surface.

17. A hockey training device, comprising:

a) a base having a first end and a second end;

b) a side having a bottom end and a top end, the bottom end of said side pivotally connected to the first end of said base;

c) a telescoping connector pivotally connected to the second end of said base and the top end of said side such that said base, said side and said telescoping connector form a triangle; and d) a plurality of studs mounted on the hockey training device to support the hockey training device above a playing surface, each of said plurality of studs comprising a three-position stud having a neutral position wherein the stud lies in the same plane as the hockey training device, a top position wherein the stud extends above a first face of the hockey training device, and a bottom position wherein the stud extends above a second face of the hockey training device.

18. A hockey training device, comprising:

a) a base having a first end and a second end;

b) a side having a bottom end and a top end, the bottom end of said side pivotally connected to the first end of said base;

c) a telescoping connector pivotally connected to the second end of said base and the top end of said side such that said base, said side and said telescoping connector form a triangle, said telescoping connector comprising a tubular channel and a solid rod slidably disposed within the tubular channel; and d) at least one locating surface mounted on the hockey training device to support the hockey training device above a playing surface.

* * * * *